US008275333B2

(12) United States Patent
Park et al.

(10) Patent No.: US 8,275,333 B2
(45) Date of Patent: Sep. 25, 2012

(54) APPARATUS AND METHOD FOR SWITCHING RADIO CHANNEL

(75) Inventors: Jun-Hyo Park, Gumi-si (KR); Hye-Jung Kim, Busan (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 72 days.

(21) Appl. No.: 12/942,412

(22) Filed: Nov. 9, 2010

(65) Prior Publication Data

US 2011/0111713 A1 May 12, 2011

(30) Foreign Application Priority Data

Nov. 12, 2009 (KR) ..... 10-2009-0109274

(51) Int. Cl.
*G04B 1/18* (2006.01)
*H04K 3/00* (2006.01)

(52) U.S. Cl. ..... 455/154.1; 455/161.1; 455/184.1

(58) Field of Classification Search ..... 455/45, 455/154.1–155.1, 161.1–161.3, 184.1–186.1
See application file for complete search history.

(56) References Cited

U.S. PATENT DOCUMENTS 5,471,662 A * 11/1995 Shiota ..... 455/166.1
7,403,755 B2 * 7/2008 Zehnle et al. ..... 455/186.1

* cited by examiner

*Primary Examiner* — Lee Nguyen
(74) *Attorney, Agent, or Firm* — Jefferson IP Law, LLP

(57) ABSTRACT

An apparatus and a method for switching to a channel including good receiving sensitivity among a plurality of channels for the same broadcast service are provided. The apparatus includes a radio broadcast receiving unit for receiving a radio broadcast, a display unit for indicating an existence of another frequency channel, through which it is possible to listen to a current broadcast, and a control unit for notifying a user of the existence of the other frequency channel if the other frequency channel exists for listening to the current broadcast service, and for switching a current channel to the other frequency channel to listen to the broadcast service through the other frequency channel if the other frequency channel is selected.

11 Claims, 3 Drawing Sheets

APPARATUS AND METHOD FOR SWITCHING RADIO CHANNEL

PRIORITY

This application claims the benefit under 35 U.S.C. §119 (a) of a Korean patent application filed in the Korean Intellectual Property Office on Nov. 12, 2009 and assigned Serial No. 10-2009-0109274, the entire disclosure of which is hereby incorporated by reference.

BACKGROUND OF THE INVENTION

1. Field of the Invention

The present invention relates to an apparatus and a method for switching a radio channel. More particularly, the present invention relates to an apparatus and a method for switching to a selected channel with good receiving sensitivity among a plurality of channels for the same broadcast service.

2. Description of the Related Art

In a case of conventional Alternative Frequency (AF) switching, an automatic search for another channel is performed only when a Received Signal Strength Indicator (RSSI) of a currently received broadcast service is below a preset level.

However, the automatic search for another channel described above is important only for a radio of a vehicle, and automatic channel switching does not easily occur except during vehicle movement, and the like.

Further, the RSSI of a broadcast does not always reflect a state of sound quality, and sound including noise that occurs at a high noise level.

Also, the same broadcast service may be provided through two frequency channels, for example, 102.5 MHz and 101.6 MHz, in a particular area. In this case, if a user selects and uses the broadcast service through the 101.6 MHz frequency channel, the user may not be aware of the existence of the same broadcast service being provided through the 102.5 MHz frequency channel. Moreover, the broadcast service provided through the 102.5 MHz frequency channel may have better sound quality. In this case, channel switching to another frequency channel cannot occur without movement to a distant area.

Therefore, a need exists for an apparatus and method for switching to another frequency channel with better sound quality for listening to the same broadcast service.

SUMMARY OF THE INVENTION

An aspect of the present invention is to address the above-mentioned problems and/or disadvantages and to provide at least the advantages described below. Accordingly, an aspect of the present invention is to provide an apparatus and a method for switching to a selected channel with good receiving sensitivity among a plurality of channels for the same broadcast service.

In accordance with an aspect of the present invention, an apparatus for radio channel switching is provided. The apparatus includes a radio broadcast receiving unit for receiving a radio broadcast, a display unit for indicating an existence of another frequency channel for listening to a current broadcast service, and a control unit for notifying of the existence of the other frequency channel if the other frequency channel exists for listening to the current broadcast service, and for switching a current channel to the other frequency channel to listen to the broadcast service through the other frequency channel if the other frequency channel is selected.

In accordance with another aspect of the present invention, a method for radio channel switching is provided. The method includes determining whether another frequency channel exists for listening to a current broadcast service, in a radio listening mode, notifying of an existence of the other frequency channel for listening to the current broadcast service, if it is determined that the other frequency channel exists, and switching a current channel to the other frequency channel to listen to the broadcast service through the other frequency channel if the other frequency channel is selected.

In accordance with still another aspect of the present invention, a method for radio channel switching is provided. The method includes A method for radio channel switching, the method comprising: receiving a radio broadcast; indicating an existence of another frequency channel for listening to a current broadcast service; notifying the existence of the other frequency channel if the other frequency channel exists for listening to the current broadcast service; and switching a current channel to the other frequency channel to listen to the broadcast service through the other frequency channel if the other frequency channel is selected.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
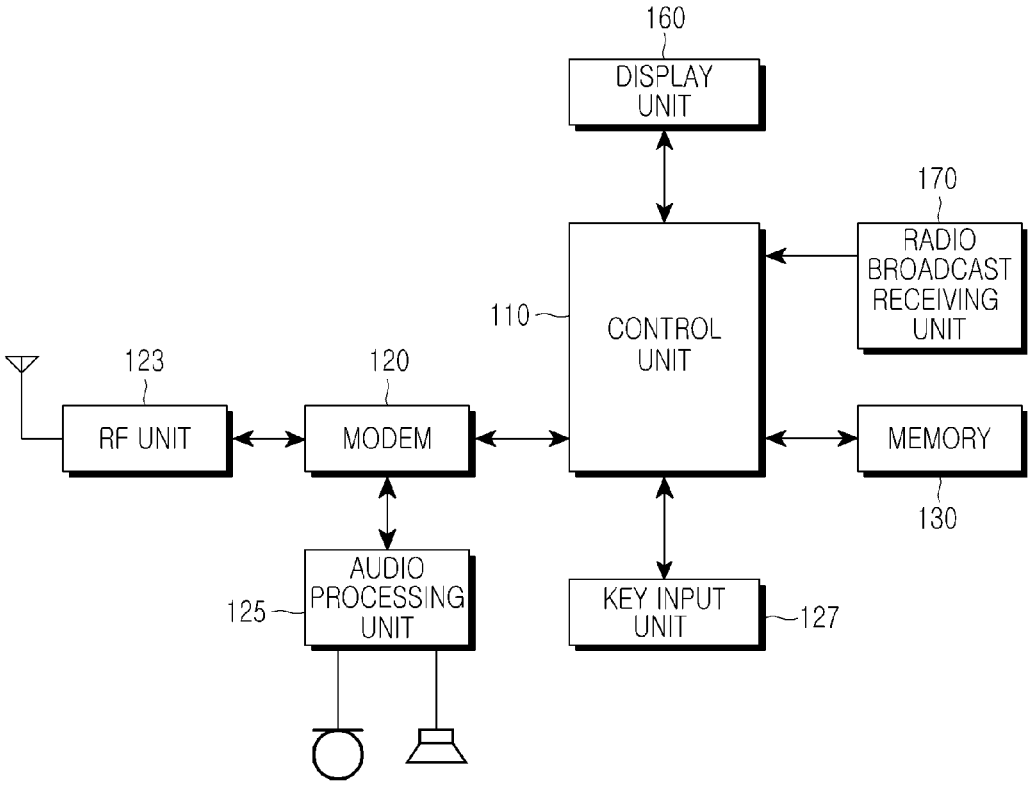
FIG. 1 is a block diagram illustrating a portable terminal according to an exemplary embodiment of the present invention.

FIG. 1 is a block diagram illustrating a portable terminal according to an exemplary embodiment of the present invention.

Referring to FIG. 1, the portable terminal includes a Radio Frequency (RF) unit 123, a control unit 110, a modem 120, a memory 130, a key input unit 127 an audio processing unit 125 a display unit 160 and a radio broadcast receiving unit 170. The RF unit 123 performs a wireless communication function of a portable terminal. The RF unit 123 includes an RF transmitter for up-converting and amplifying frequency of an outgoing signal, and an RF receiver for low noise amplifying and down-converting an incoming signal. The modem 120 includes a transmitter for encoding and modulating the outgoing signal and a receiver for demodulating and decoding the incoming signal. The audio processing unit 125 may include a codec. The codec includes a data codec for processing packet data, and the like, and an audio codec for processing an audio signal, such as voice. The audio processing unit 125 converts a digital audio signal received through the modem 120 into an analog signal through the audio codec, or converts an analog audio signal transmitted from a microphone into a digital audio signal through the audio codec and transmits the converted digital audio signal to the modem 120. The codec may be either separately arranged or included in the control unit 110.

The memory 130 includes a program memory and a data memory. The program memory stores programs for controlling general operations of the portable terminal, and the data memory temporarily stores data generated during execution of the programs.

Further, the memory 130 stores a frequency channel, which is extracted from Radio Data System (RDS) information of a current broadcast service and enables listening of the current broadcast service according to an exemplary embodiment of the present invention.

Also, the memory 130 stores a Received Signal Strength Indicator (RSSI) and a Signal-to-Noise Ratio (SNR) of another frequency channel, which is extracted from the RDS information of a current broadcast service and enables listening of the current broadcast service according to an exemplary embodiment of the present invention.

The display unit 160 displays user data output from the control unit 110. The control unit 110 may be implemented with a Liquid Crystal Display (LCD). In this case, the display unit 160 may include an LCD controller, a memory capable of storing image data, and an LCD display device. If the LCD is implemented as a touch screen type LCD, the LCD may function as an input unit.

Further, the display unit 160 may display an icon indicating that there is another frequency channel for listening to the currently received broadcast service in a radio listening mode according to an exemplary embodiment of the present invention.

Moreover, if there are other frequency channels, through which it is also possible to listen to the currently received broadcast service in the radio listening mode, the display unit 160 may display at least one of the number of the other frequency channels and the frequencies corresponding to the other frequency channels.

The key input unit 127 includes keys for inputting at least one of number and letter information, and function keys for setting various functions.

The radio broadcast receiving unit 170 receives and demodulates a radio broadcast signal transmitted through air waves.

The control unit 110 controls the general operations of the portable terminal and may include the modem 120 and a codec.

In an exemplary implementation, the control unit 110 receives broadcast data system information of a current broadcast service in the radio listening mode, and determines, based on the broadcast data system information, if there is another frequency channel for listening to the currently received broadcast service.

In addition, if the control unit 110 determines that there is another frequency channel for listening to the currently received broadcast service in the radio listening mode according to an exemplary embodiment of the present invention, the control unit 110 counts the number of other frequency channels for listening to the currently received broadcast service. If there is only a single frequency channel for listening to the currently received broadcast service, the control unit 110 switches the current channel to the other single channel so that a user may listen to the broadcast service through the other single channel. However, if there are multiple channels for listening to the currently received broadcast service, the control unit 110 switches the current channel to a channel, which has at least one of the highest RSSI and the highest SNR among the multiple channels, so that the user may listen to the broadcast service through the switched channel.

The radio channel switching operation of the portable terminal as described above will be discussed below with reference to FIGS. 2 and 3A-3D.

Figure 2:
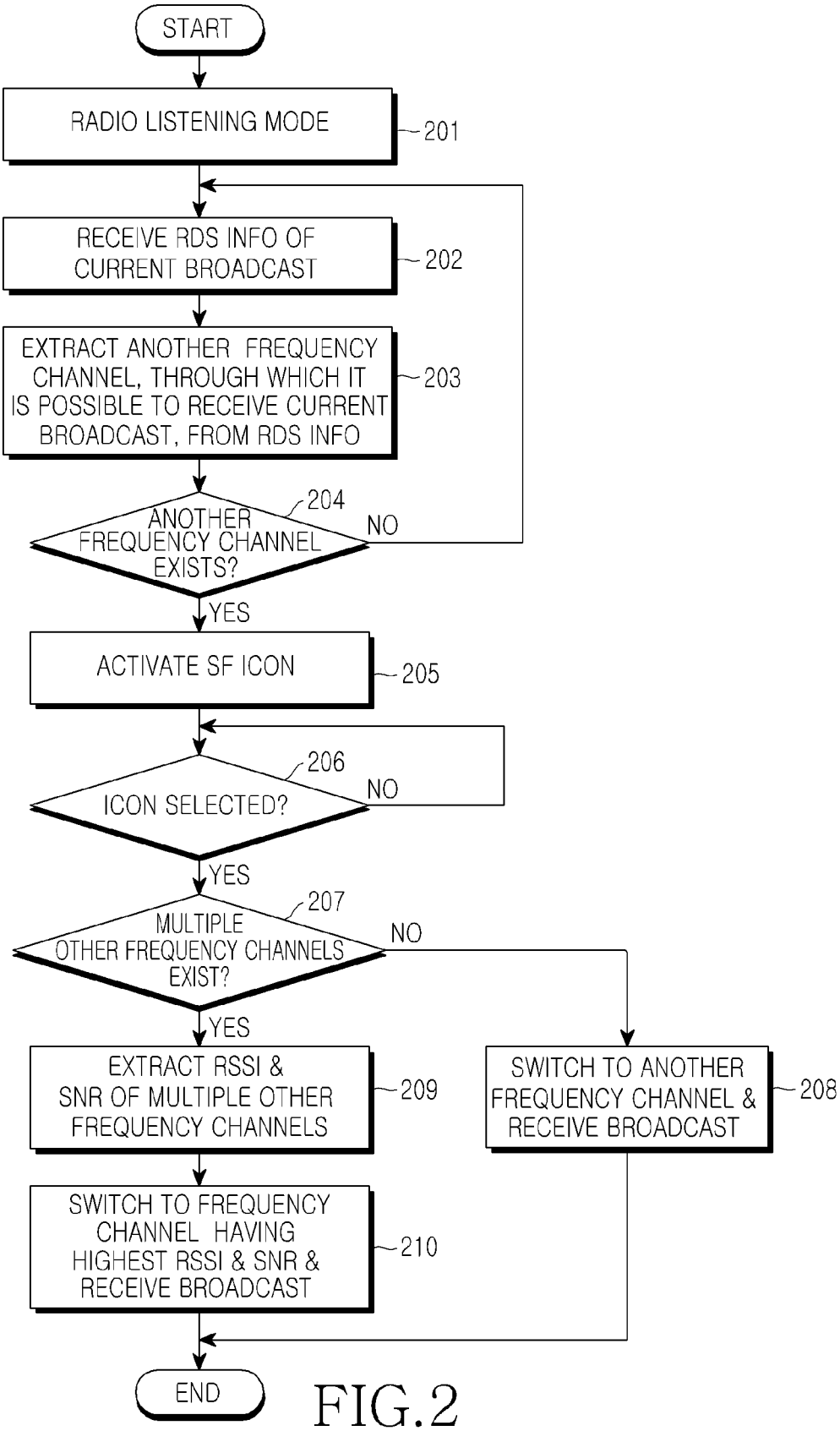
FIG. 2 is a flowchart illustrating a radio channel switching operation of a portable terminal according to an exemplary embodiment of the present invention.

FIG. 2 is a flowchart illustrating a radio channel switching operation of a portable terminal according to an exemplary embodiment of the present invention.

Referring to FIG. 2, in a radio listening mode, a user may select and listen to a broadcast service in step 201. While the user listens to the current broadcast service, the control unit 110 receives RDS information of the current broadcast service in step 202. The RDS information includes a frequency channel of the current broadcast service and frequency channels for the same broadcast service.

In step 203, the control unit 110 decodes the received RDS information and extracts another frequency channel for listening to the current broadcast service, from the decoded information.

If the other frequency channel for listening to the current broadcast service has been extracted from the decoded information in step 203, the control unit 110 determines that another frequency channel exists for listening to the current broadcast service in step 204. In step 205, the control unit 110 activates a Switch Frequency (SF) icon in order to notify that another frequency channel exists for listening to the current broadcast service.

The SF icon is displayed on the display unit 160 and is activated by the control unit 110 to notify the existence of another frequency channel for listening to the current broadcast service, if the other frequency channel exists.

If the SF icon is selected by the user while the SF icon is activated and displayed in step 205, in step 206 the control unit 110 detects the SF icon selection, and determines the number of other frequency channels through which it is possible to listen to the current broadcast, in step 207.

If it is determined that there is a single frequency channel for listening to the current broadcast service, the control unit 110 detects the other single frequency channel in step 207, and switches the current frequency channel to the other single frequency channel and listens to the broadcast service through the other single frequency channel in step 208.

In contrast, if it is determined that a plurality of other frequency channels exists for listening to the current broadcast service, the control unit 110 detects the plurality of other frequency channels in step 207, and extracts and stores at least one of the RSSI and the SNR of the plurality of other frequency channels in step 208.

In step 210, the control unit 110 switches the current frequency channel to a frequency channel having at least one of the highest RSSI and highest SNR from among the plurality of other frequency channels extracted in step 209, and receives the broadcast service through the switched frequency channel.

FIGS. 3A to 3D illustrate display screens of a radio channel switching operation of a portable terminal according to an exemplary embodiment of the present invention.

Figure 3A:
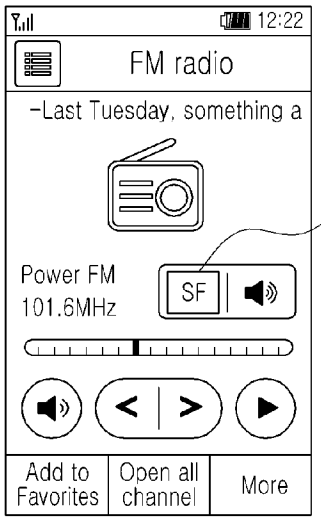
FIGS. 3A to 3D illustrate display screens of a radio channel switching operation of a portable terminal according to an exemplary embodiment of the present invention.

Referring to FIG. 3A, the portable terminal illustrates a screen in the radio listening mode, as described in step 210, in which the user listens to a selected broadcast service through the frequency of 101.6 MHz.

Figure 3B:
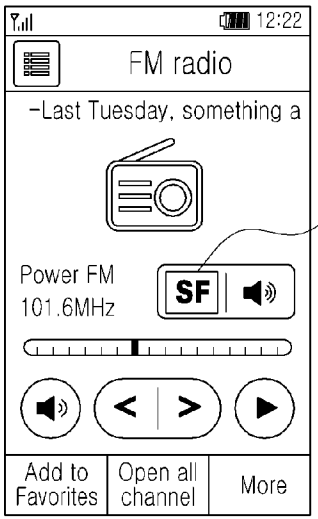

FIG. 3B illustrates a screen, as described in step 205, in which the SF icon 301 is activated in order to notify the user that another frequency channel exists for listening to the current broadcast service.

Figure 3C:
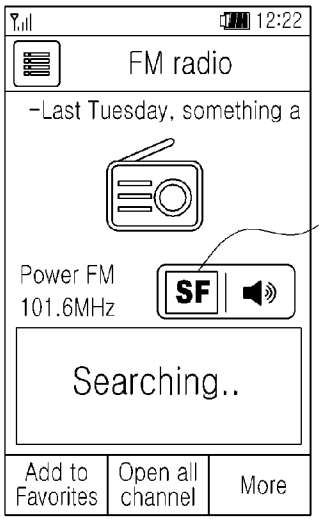

FIG. 3C illustrates a screen in which another frequency channel for listening to the current broadcast service, is being searched after the SF icon 301 is selected.

Figure 3D:
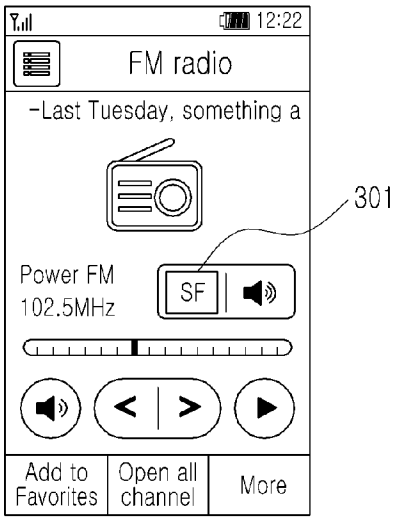

FIG. 3D illustrates a screen in which the current broadcast service is received through the 102.5 MHz frequency channel, which is another frequency channel for listening to the current broadcast service, based on the user's selection of the SF icon 301.

As described above, exemplary embodiments of the present invention provide an apparatus and a method for switching to a frequency channel with good receiving sensitivity among a plurality of channels for the same broadcast service according to user's selection, thereby notifying the user that another frequency exists, for receiving the same broadcast service as the currently received broadcast service.

Further, according to the exemplary embodiments of the present invention the current frequency channel for listening to a broadcast service, can be switched to another frequency channel with better sound quality or stronger signal intensity.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. An apparatus for radio channel switching, the apparatus comprising:

a radio broadcast receiving unit for receiving a radio broadcast;

a display unit for indicating an existence of another frequency channel for listening to a current broadcast service; and a control unit for notifying the existence of the other frequency channel by activating a Switch Frequency (SF) icon displayed on the display unit, if the other frequency channel exists for listening to the current broadcast service, and for switching a current channel to the other frequency channel to listen to the broadcast service through the other frequency channel if the activated Switch Frequency (SF) icon is selected.

2. The apparatus of claim 1, wherein the existence of the other frequency channel for listening to the current broadcast service is indicated through activation of an icon.

3. The apparatus of claim 1, wherein the display unit displays at least one of a number of other channels for listening to the current broadcast service and frequencies corresponding to the other channels.

4. The apparatus of claim 1, wherein the control unit receives broadcast data system information of the current broadcast service, decodes the received broadcast data system information and determines whether the other frequency channel exists for listening to the current broadcast.

5. The apparatus of claim 1, wherein the control unit determines the number of the other frequency channels for listening to the current broadcast service, if channel switching is selected, switches a current frequency channel to another single frequency channel and receives the current broadcast service through the other single frequency channel if the other frequency channels for listening to the current broadcast service include only the other single frequency channel, and switches a current frequency channel to a new frequency channel and receives the current broadcast service through the new frequency channel if the other frequency channels for listening to the current broadcast service include a plurality of frequency channels including the new frequency channel, wherein the new frequency channel comprises at least one of a highest Received Signal Strength Indicator (RSSI) and a highest Signal-to-Noise Ratio (SNR) among the plurality of frequency channels.

6. A method for radio channel switching, the method comprising:

determining whether another frequency channel exists for listening to a current broadcast service, in a radio listening mode;

notifying of an existence of the other frequency channel for listening to the current broadcast service by activating a Switch Frequency (SF) icon on the display unit, if it is determined that the other frequency channel exists; and switching a current channel to the other frequency channel to listen to the broadcast service through the other frequency channel if the activated Switch Frequency (SF) icon is selected.

7. The method of claim 6, wherein the determining of whether the other frequency channel exists comprises:

receiving broadcast data system information of the current broadcast service; and decoding the received broadcast data system information and determining whether the other frequency channel exists for listening to the current broadcast service.

8. The method of claim 6, wherein the existence of the other frequency channel for listening to the current broadcast service is indicated through activation of an icon.

9. The method of claim 6, wherein the notifying of the existence of the other frequency channel comprises displaying at least one of a number of other channels for listening to the current broadcast service and frequencies corresponding to the other channels.

10. The method of claim 6, wherein the switching of the current channel to the other frequency channel to listen to the broadcast service through the other frequency channel comprises:

determining the number of other frequency channels for listening to the current broadcast, if the channel switching is selected;

switching a current frequency channel to another single frequency channel and receiving the current broadcast service through the other single frequency channel if the other frequency channels for listening to the current broadcast service include only the other single frequency channel; and switching a current frequency channel to a new frequency channel and receiving the current broadcast service through the new frequency channel if the other frequency channels for listening to the current broadcast service include a plurality of frequency channels including the new frequency channel, wherein the new frequency channel comprises at least one of a highest Received Signal Strength Indicator (RSSI) and a highest Signal-to-Noise Ratio (SNR) among the plurality of frequency channels.

11. A method for radio channel switching, the method comprising:

determining whether at least one other frequency channel exists for listening to a current broadcast service while in a radio listening mode;

displaying a Switch Frequency (SF) icon if it is determined that at least one other frequency channel exists;

determining if the SF icon is selected by a user;

upon determination that the SF icon has been selected by the user, determining whether a multiple of frequency channels besides the at least one other frequency channel exists for listening to the current broadcast service; and if it is determined that the multiple of frequency channels exist, switching the current channel to one of the multiple of frequency channels and the at least one other frequency channel having at least one of the highest Received Signal Strength Indicator (RSSI) and the highest Signal to Noise Ratio (SNR).

* * * * *